US005570963A

United States Patent [19]

Gill

[11] Patent Number: 5,570,963

[45] Date of Patent: Nov. 5, 1996

[54] INK TRANSFER ROLLER FOR RIBBON CARTRIDGES

[75] Inventor: Narinder Gill, Chatsworth, Calif.

[73] Assignee: Sercomp Corporation, Chatsworth, Calif.

[21] Appl. No.: 502,664

[22] Filed: Jul. 14, 1995

[51] Int. Cl.[6] ..... B41J 31/14

[52] U.S. Cl. ..... 400/197; 400/196; 492/31; 492/36; 492/38

[58] Field of Search ..... 400/197, 192, 400/196, 196.1, 202.4, 202, 195, 200, 201, 202, 202.1–202.4; 492/17, 18, 24, 25, 28, 38, 48, 49, 31, 36

[56] References Cited

U.S. PATENT DOCUMENTS

| | | | |
|---|---|---|---|
| 1,094,361 | 4/1914 | Blevney | 492/31 |
| 2,053,604 | 9/1936 | Dullinger | 492/24 |
| 2,391,754 | 12/1945 | Thoma | 492/36 |
| 2,572,276 | 10/1951 | Moe | 492/36 |
| 4,887,921 | 12/1989 | Hayashi et al. . | |
| 4,913,571 | 4/1990 | Bulson et al. . | |
| 5,015,108 | 5/1991 | Paterra et al. . | |
| 5,059,045 | 10/1991 | Mrvos et al. . | |
| 5,207,519 | 5/1993 | Debreczenyi . | |
| 5,211,490 | 5/1993 | Suzawa et al. . | |
| 5,230,575 | 7/1993 | Kulesa et al. . | |
| 5,401,108 | 3/1995 | Debreczenyi | 400/202.4 |

FOREIGN PATENT DOCUMENTS

| | | | |
|---|---|---|---|
| 0049987 | 3/1985 | Japan | 400/201 |
| 0664290 | 3/1994 | Japan | 400/202.4 |

*Primary Examiner*—Edgar S. Burr
*Assistant Examiner*—Anthony H. Nguyen
*Attorney, Agent, or Firm*—Koda and Androlia

[57] ABSTRACT

An ink transfer roller for transferring ink from a re-inking roller to an endless ribbon in ink ribbon cartridges for, for instance, impact printers being contoured on the outer surface. The roller is a cylinder having a central ridge raised in the middle of the outer surface of the roller and a plurality of branch ridges extending from both edges of the central ridge so as to be equally spaced from each other in the circumferential direction for inking the ribbon in proportion to the ratio as the ink is used.

2 Claims, 3 Drawing Sheets

INK TRANSFER ROLLER FOR RIBBON CARTRIDGES

BACKGROUND OF THE INVENTION

1. Field of the Invention

The present invention relates to ribbon cartridges for use in impact type printers such as line printers, typewriters and wire-dot printers and more particularly to an ink transfer roller used in ribbon cartridges for re-inking endless ink ribbons.

2. Prior Art

An impact type printer, such as a wire-dot printer, typically uses a ribbon cartridge that stores therein an ink ribbon which is impregnated with ink. The ink is impregnated in the ribbon by an ink transfer roller. The ink will be depleted long before the ribbon wears out, and as the ribbon's supply of ink becomes depleted, print quality becomes increasingly lighter.

A variety of devices have been proposed to re-ink the ribbon so as to derive further use from the ribbon cartridge. FIG. 1 shows a typical prior art re-inking system. The re-inking assembly is installed in the housing of a ribbon cartridge 10 and includes a re-inking roller 12 which is formed from a porous material saturated with ink and an ink transfer roller 14 which is mounted for rotation tangentially to the re-inking roller 12.

The ink ribbon drive assembly drives and advances an endless loop ribbon 16 so that the ribbon 16 is brought into contact with a portion of the transfer roller 12 as it is advanced along its path. More specifically, ink is transferred from the re-inking roller 12 to the transfer roller 14 and then to the ribbon 16 in a manner that the ribbon is continuously re-inked.

In a typical prior art ink ribbon cartridge as described above, the ink transfer roller 14 is a simple cylinder shape as shown in FIG. 2. In other words, it has a smooth external circumferential surface. With this type of ink transfer roller, the ink is transferred onto the ribbon uniformly along a vertical cross-section of the ribbon because of the smooth and not-contoured surface of the roller. This, however, causes the ribbon concentration to become too high in some places while not being enough in other places, causing inconsistent print quality and less character yield.

In the mean time, some printers and typewriters feed ribbons in an inclined manner so that the print head can make a largest possible contact with the ink ribbon surface. This type of ribbon feeding is shown in FIG. 3. In this type of ribbon feeding, the ribbon 16 is divided into three different regions: the central region 16*a*, the intermediate regions 16*b* located on both (upper and lower) sides of the central region 16*a*, and edge regions 16*c* located between the intermediate regions 16*b* and the edges 50*d* of the ribbon 16. The intermediate regions 16*b* are printed on one time during each passage in front of the printing head of a printer, and the central region 16*a* is printed on twice during each passage in front of the printing head. The edge regions 16*c* are not printed on or not used in printing. Parallel dot lines indicate the paths of the upper and lower end print hammers of the print head (not shown).

In other words, the ink in the central region 16*a* is consumed twice as much as the ink in the intermediate regions 16*b*. However, merely with the cylindrical ink transfer roller 14, as shown in FIG. 2, is the ink transferred to the ribbon 16 uniformly. As a result, ink is in fact not applied onto the ribbon 16 from where it was consumed and in the amount that it was used. In addition, the configurations of the characters and symbols to be printed or typed differ greatly, and therefore, ink on the ribbon is not depleted or consumed evenly. Nonetheless, the ribbon is re-inked evenly and uniformly with the prior art cylindrical roller as shown in FIG. 2, and the results are inconsistent print quality and less characteristic yield.

SUMMARY OF THE INVENTION

Accordingly, it is a primary object of the present invention to provide an ink transfer roller used in ribbon cartridges that can re-ink the ribbon unevenly.

It is another object of the present invention to provide a contoured ink transfer roller that can re-ink the ribbon in proportion to the amount of ink consumed.

The above and other objects of the present invention are accomplished by a unique structure for an ink transfer roller wherein the roller is contoured so that the actual surface area of contact of the roller is adjusted to allow it to put ink back into the ribbon from where it was removed and also in the amount that it was used. In particular, the roller of the present invention is provided with a central ridge around the central area of a cylindrical roller main body, and a plurality of axially extending branch ridges are formed continuously from the edges of the central ridge in a manner that they are evenly spaced from each other in the circumferential direction.

With this structure, the roller is contoured so that it can adjust the actual surface area of contact in order to allow the roller to put ink back into the ribbon from where it was used up. In other words, ink is transferred from the roller to ribbon in accordance with the ink consumed.

Other objects, features, and advantages of the present invention will become apparent from reading the following specification when taken in conjunction with the accompanying drawings and the appended claims.

DETAILED DESCRIPTION OF THE INVENTION

Figure 1:
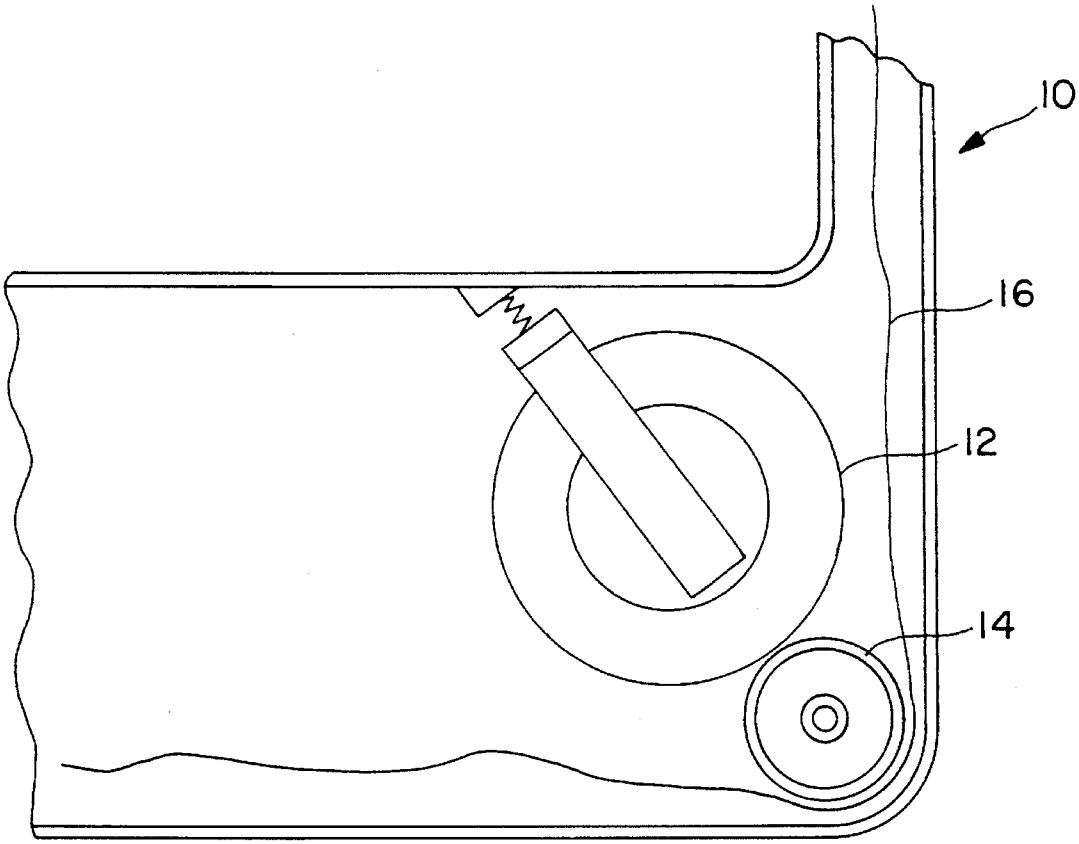
FIG. 1 PRIOR ART
FIG. 1 is a top view of a re-inking system currently utilized in ribbon cartridges that includes a re-inking roller and an ink transfer roller.
Figure 2:
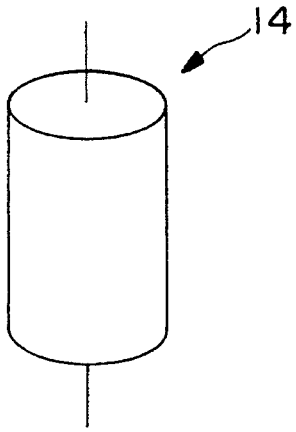
FIG. 2 PRIOR ART
FIG. 2 shows a conventional ink transfer roller.
Figure 3:
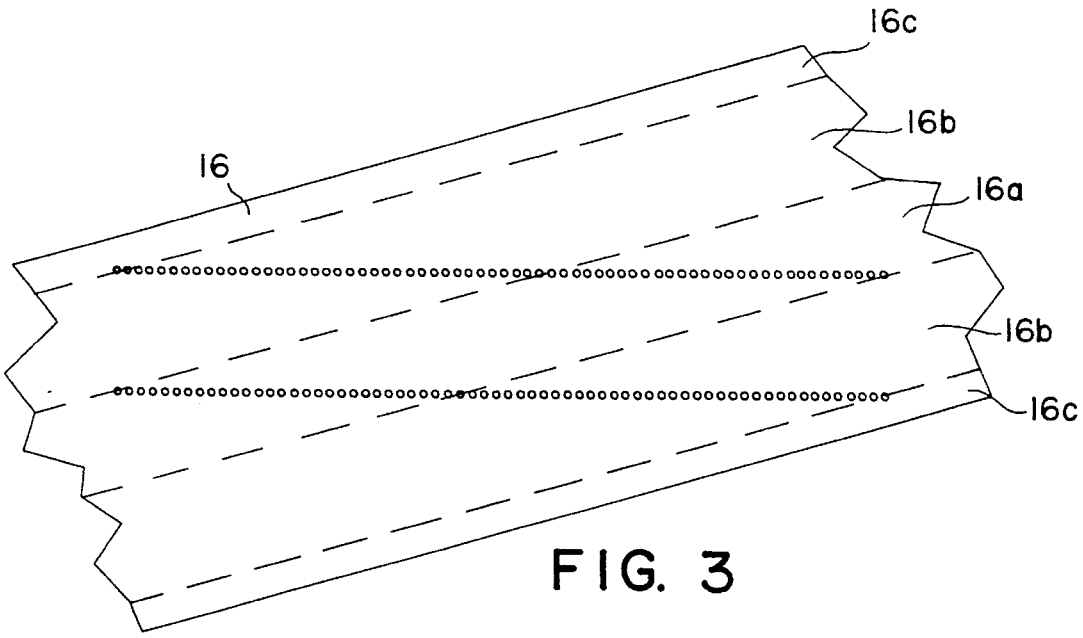
FIG. 3 shows a part of an ink ribbon divided into three regions used in an inclined ribbon feeding system.
Figure 4:
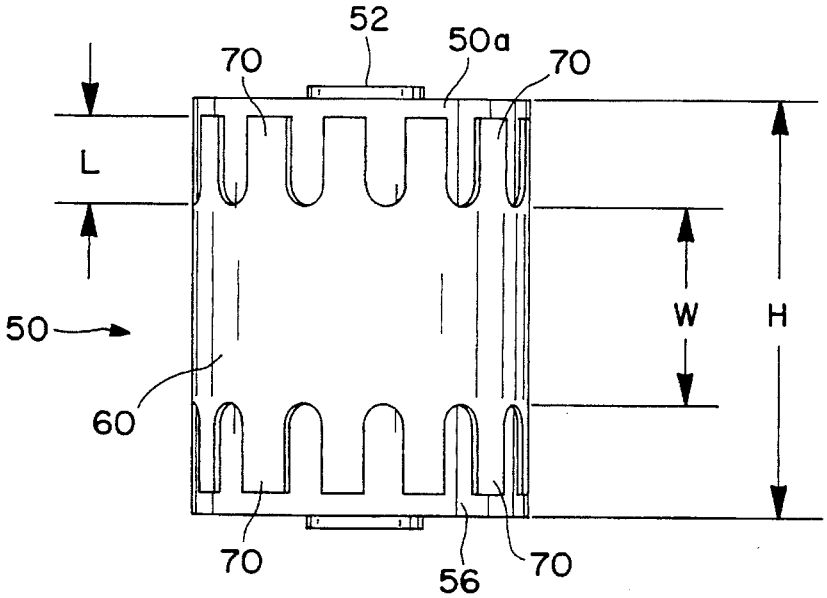
FIG. 4 is a front elevational view of the ink transfer roller according to one embodiment of the present invention.
Figure 5:
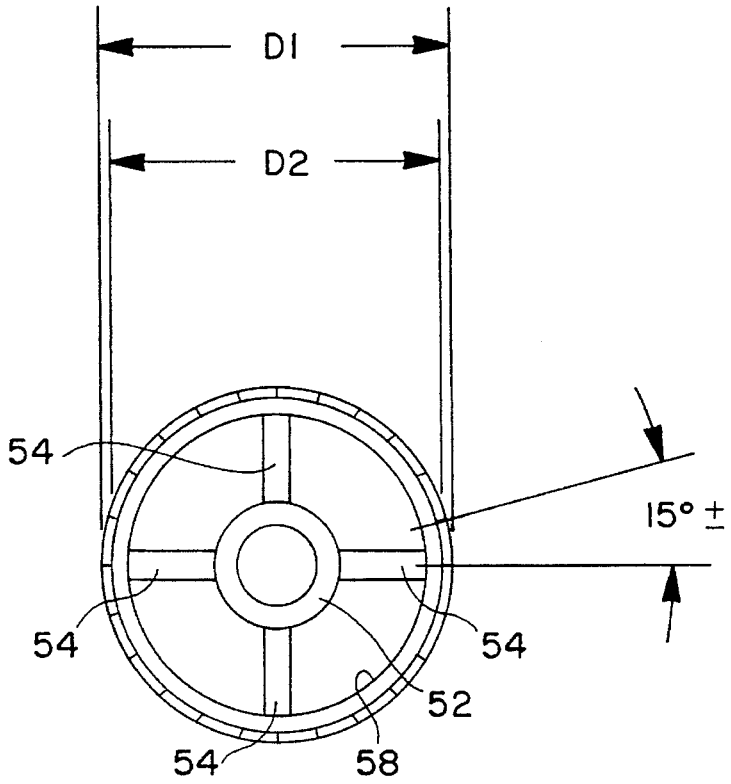
FIG. 5 is a top view thereof.
Figure 6:
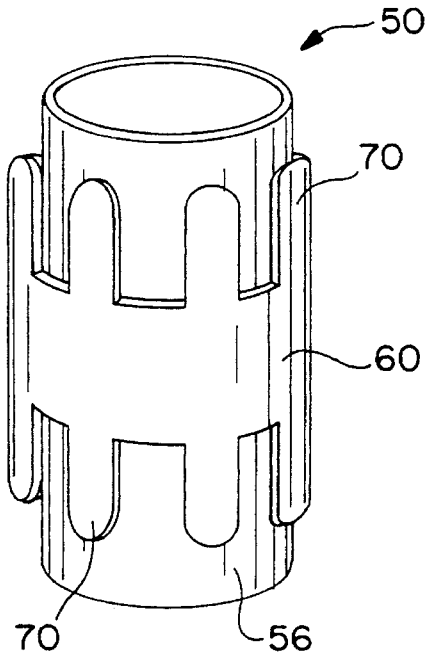
FIG. 6 is a perspective view of the ink transfer roller according to another embodiment of the present invention.

As seen from FIGS. 4 to 6, the ink transfer roller 50 of the present invention which is installed in an ink cartridge (not shown) in a rotatable fashion as in the prior art comprises a main cylindrical body 50*a*. The cylindrical main body 50*a* has an inner tube 52 at the center via four ribs 54. The roller 50 is rotated about the central tube 52 that is fitted on a bearing shaft (not shown) provided in the bottom of an ink cartridge casing (not shown).

The ink transfer roller 50 has an outer surface 56 and an inner surface 58. On the outer surface 56 is provided a raised central ridge 60. The central ridge 60 is formed for the entire outer circumference of the main cylindrical body 50*a*. The central ridge 60 is provided with a plurality of branch ridges 70 that continuously extend from both upper and lower edges of the central ridge 60 vertically or in an axial direction of the roller 50 so that the branch ridges 70 entirely surround the outer surface 56 of the roller 50. The branch ridges 70 are equally spaced from each other in the circumferential direction of the roller 50. The ends of the branch ridges 70 can be curved as shown in FIG. 6 or be horizontally straight as shown in FIG. 5.

The ink transfer roller 50 can be obtained as a single unit by molding the cylindrical main body 50*a* and the central ridge 60 having the branch ridges 70 together, or it can be obtained by making the main body 50*a* and the central ridge 60 having the branch ridges 70 separately and then put them together using, for example, glue.

In the embodiment shown in the FIGS. 4 and 5, twenty-four (24) branch ridges 70 are formed on the roller 50. In particular, there are twelve (12) branch ridges 70 on the upper side of the central ridge and twelve (12) branch ridges 70 on the lower side of the central ridge 60 in an equally spaced fashion on the cylindrical outer surface 56 of the roller 50. In other words, the branch ridges 70 are provided substantially 15 degrees apart from each other.

With the structure as described above, the area of the central ridge 60 of the roller 50 that comes into contact with the central region of an ink ribbon is substantially twice as large as the area of the plurality of the branch ridges 70 combined. In other words, the plurality of branch ridges 70 combined can replenish a ribbon with substantially half the amount of ink than the central ridge 60 can.

In one embodiment, the diameter D1 (see FIG. 5) of the main cylindrical body 50*a* is 0.81 inches, and the diameter D1 of the central ridge 60 formed on the outer surface 56 of the main cylindrical body 50*a* is 0.85 inches. Thus, the raised central ridge 60 and the branch ridges 70 which are continuous from the central ridge 60 have a thickness or a height of 0.02 inches. In addition, the height H of the cylindrical main body 50*a* is 0.99 inches, the width W of the central ridge 60 is 0.468 inches, and the length L of each of the branch ridges 70 is 0.211 inches.

Accordingly, with the use of the ink transfer roller as described above, the central ridge 60 of the roller 10 replenishes ink to an ink ribbon twice as much as the branch ridges 70 do. Thus, ink is replenished onto the surface of the ribbon in the same ratio that it is used so that ink replenishing can comply with the fact that the intermediate regions of an ink ribbon are printed on one time during each pass in front of printing heads while the central region of the ribbon is printed on twice during each pass in front of the printing heads. In other words, the central ridge 60 that mainly comes into contact with the central region of a ribbon replenishes the ribbon with ink twice as much as the branch ridges 70 do that come into contact mainly with the intermediate regions which are located on both sides of the central region of the ribbon. In other words, the ink transfer roller 50 replenishes ink unevenly, and ink is transferred to the ribbon in proportion to the amount of ink used so that the print density or darkness can be consistent, providing an improved character yield of the ribbon cartridge The embodiments described above are to be considered in all respects as illustrative and not restrictive, and all changes which come within the meaning and range of equivalency of the claims are, therefore, intended to be embraced therein.

I claim:

1. An ink transfer roller used in a ribbon cartridge comprising:

a main cylindrical body having an external surface and an internal surface;

a continuous central ridge provided circumferentially on said external surface of said cylindrical body; and a plurality of branch ridges extending from both edges of said central ridge in a longitudinal direction of a longitudinal axis of said main cylindrical body, said branch ridges being equally spaced from each other in a circumferential direction of said cylindrical main body.

2. An ink transfer roller according to claim 1, wherein said central ridge is substantially twice as large in area as said plurality of branch ridges combined.

* * * * *